US005934110A

United States Patent [19]

Nitsche

[11] Patent Number: 5,934,110

[45] Date of Patent: Aug. 10, 1999

[54] LAUNDRY DRUM FOR A WASHING MACHINE AND TOOL FOR PRODUCING THE SAME

[75] Inventor: Alfred Nitsche, Berlin, Germany

[73] Assignee: BSH Bosch und Siemens Hausgeraete GmbH, Munich, Germany

[21] Appl. No.: 08/988,260

[22] Filed: Dec. 10, 1997

[30] Foreign Application Priority Data

Dec. 10, 1996 [DE] Germany ..... 196 51 295

[51] Int. Cl.[6] ..... D06F 37/04

[52] U.S. Cl. ..... 68/142

[58] Field of Search ..... 68/142, 23 R; 34/596, 602; 210/380.2; 220/676

[56] References Cited

U.S. PATENT DOCUMENTS

| | | | |
|---|---|---|---|
| 2,574,170 | 11/1951 | Cockerill et al. | 210/380.2 X |
| 4,202,187 | 5/1980 | Hukuzawa et al. | 210/380.2 X |
| 4,771,615 | 9/1988 | Fukuzawa et al. | 210/380.2 X |
| 4,888,965 | 12/1989 | Fanson et al. | 210/380.2 X |
| 4,920,661 | 5/1990 | Fukuzawa et al. | 34/596 X |
| 5,463,821 | 11/1995 | Gauer | 34/602 X |

*Primary Examiner*—Philip R. Coe

*Attorney, Agent, or Firm*—Herbert L. Lerner; Laurence A. Greenberg

[57] ABSTRACT

A laundry drum for a washing machine includes sheet-metal wall portions and outer portions outside the sheet-metal wall portions. The sheet-metal wall portions have holes formed therein for the passage of treatment media, such as water or air and regions surrounding the holes toward the outer portions. The regions surrounding the holes are elongated into a tuliplike or frustoconical shape and have flat-formed edges bordering the holes to assure that a burr at margins of the holes remains as harmless as possible for gentle handling of delicate laundry. A tool for producing the laundry drum has a needle for cutting the holes, a stiffening piece for bracing the sheet-metal wall portion from below, and a female stamping die guiding the needle and having an offset end surface with a diameter less than the outer diameter of the surrounding regions of the sheet-metal wall portion.

5 Claims, 3 Drawing Sheets

LAUNDRY DRUM FOR A WASHING MACHINE AND TOOL FOR PRODUCING THE SAME

BACKGROUND OF THE INVENTION

Field of the Invention

The invention relates to a laundry drum for a washing machine, having sheet-metal wall portions with holes for the passage of such treatment media as water or air, and surrounding regions facing toward the outside of the laundry drum being elongated into a tuliplike or frustoconical shape. The invention also relates to a tool for producing the laundry drum, having a guided hole-cutting needle and a stiffening piece with a cutting hole to be put in place for bracing below the level of the sheet-metal wall portions.

One such laundry drum is known from German Utility Models DE 1 756 317 U and DE 66 06 902 U. In the production of the laundry drum shown in German Utility Model DE 1 756 317 U, evidently each flow hole is first stamped out, before its tulip is drawn out. That can be seen in FIGS. 1 and 2 of German Utility Model DE 1 756 317 U from the fact that the edges of the holes are oblique to the normal on the drum jacket.

Conversely, in German Utility Model DE 66 06 902 U, the shape of the flow holes of a washing machine drum is shown in idealized form. Such flow holes are in fact, still today, typically made in the manner shown herein in FIG. 1 and discussed below.

In the prior art, burrs on the outermost edge of the sheet metal at the holes are dangerous to the fingertips and to laundry fibers that might pass through the flow holes and become caught.

SUMMARY OF THE INVENTION

It is accordingly an object of the invention to provide a laundry drum for a washing machine and a tool for producing the same, which overcome the hereinafore-mentioned disadvantages of the heretofore-known products and devices of this general type, which retain a simplified production principle and which maximally eliminate dangers to the fingertips and to laundry fibers that might pass through flow holes and catch on an outermost edge at the holes.

With the foregoing and other objects in view there is provided, in accordance with the invention, a laundry drum for a washing machine, comprising sheet-metal wall portions; outer portions outside the sheet-metal wall portions; the sheet-metal wall portions having holes formed therein for the passage of treatment media such as water or air; the sheet-metal wall portions having regions surrounding the holes toward the outer portions; the regions surrounding the holes elongated into a tuliplike or frustoconical shape, and the regions surrounding the holes having flat-formed edges bordering the holes.

After the holes have been stamped out, the flat-formed regions at the edges bordering the holes are seated on the stiffening piece, and any burr that has already formed is moved into the interior of the hole when the edge of the sheet metal at hole is retracted on the stiffening piece, and is then easily rounded toward the top by the retreating cutting needle.

In accordance with another feature of the invention, the surrounding regions have a diameter approximately twice that of the holes. As a result, the angle of the truncated cone in the surrounding regions is large enough to ensure that on one hand it can be located far enough away from the reach of the laundry, and on the other hand the edge of the sheet metal at hole is retracted far enough in the tool when the surrounding regions are drawn.

In accordance with a further feature of the invention, the flat-formed edges of the holes have a width which is a fraction of the diameter of the holes.

In accordance with an added feature of the invention, the holes are cut by cutting needles of a tool, the cutting needles have a given diameter, and the holes have a diameter larger than the given diameter.

With the objects of the invention in view, there is also provided a tool, comprising a needle for cutting hole segments in a sheet-metal laundry drum wall portion disposed at a given level, the needle drawing a tulip or truncated cone in regions of the sheet-metal wall portion surrounding the holes and having a given outer diameter; a stiffening piece with a cutting hole to be placed below the given level for bracing the sheet-metal wall portion; and a female stamping die guiding the needle in the female stamping die by seating the needle on the sheet-metal wall portions ahead of the female stamping die, the female stamping die having an offset end surface with a diameter less than the given outer diameter of the surrounding regions of the sheet-metal wall portion for forming flat-formed edges bordering the holes in the surrounding regions.

Other features which are considered as characteristic for the invention are set forth in the appended claims.

Although the invention is illustrated and described herein as embodied in a laundry drum for a washing machine and a tool for producing the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
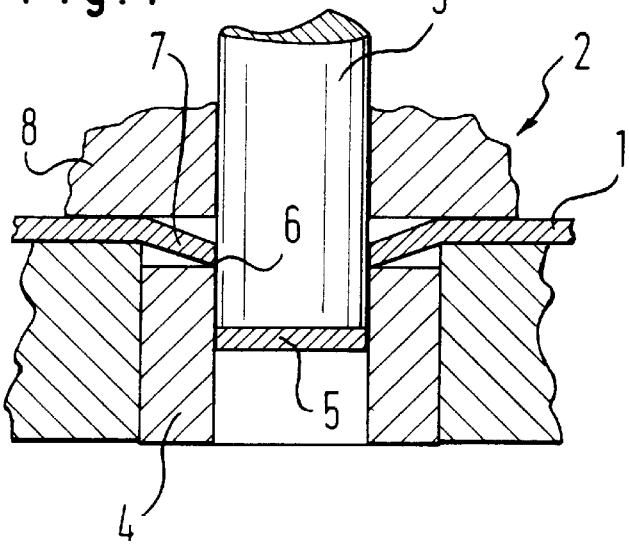
PRIOR ART Fig. 1
FIG. 1 is a fragmentary, diagrammatic, sectional view of sheet metal of a washing machine drum in a tool for producing a flow hole in the drum according to the prior art.

Referring now to the figures of the drawings in detail and first, particularly, to FIG. 1 thereof, there is seen a stamping tool 2 in which a sheet metal wall portion 1 of a drum is first drawn by one downwardly-moved cutting needle 3 for each flow hole, until it meets a stiffening piece 4 with a cutting hole, before a hole portion 5 is cut out. The stamping tool 2 has an upper part 8.

However, in the cutting process using the downwardly-moved cutting needle 3, a cut comes about that is oblique relative to a tulip-shaped indrawn sheet-metal layer of the sheet metal wall portion 1 of the drum, as a result of which a burr is drawn along a lower margin 6 of an edge 7 at the hole. This burr remains, pointing toward the outside of the drum, and is a threat from two standpoints: First, because of the burr, the lower margins 6 are so sharp that a user can rip open his or her fingertips in washing machines operated from the drum side and when the drum is turned by hand. Second, during a spin cycle, pieces of laundry slide through the flow holes at least far enough to permit individual fibers to catch on the burr and then tear later, when the drum is slowed down and the pieces of laundry drop back into the drum.

Figure 2:
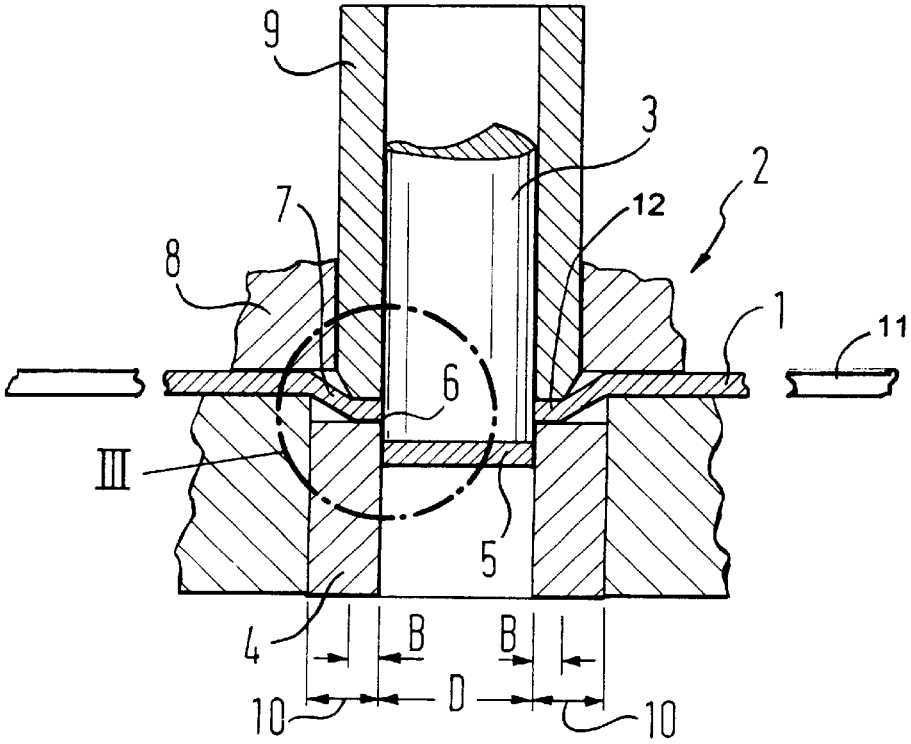
FIG. 2 is a fragmentary, sectional view of sheet metal of a washing machine drum in an embodiment of a tool similar to FIG. 1, for producing a flow hole according to the invention.
Figure 3:
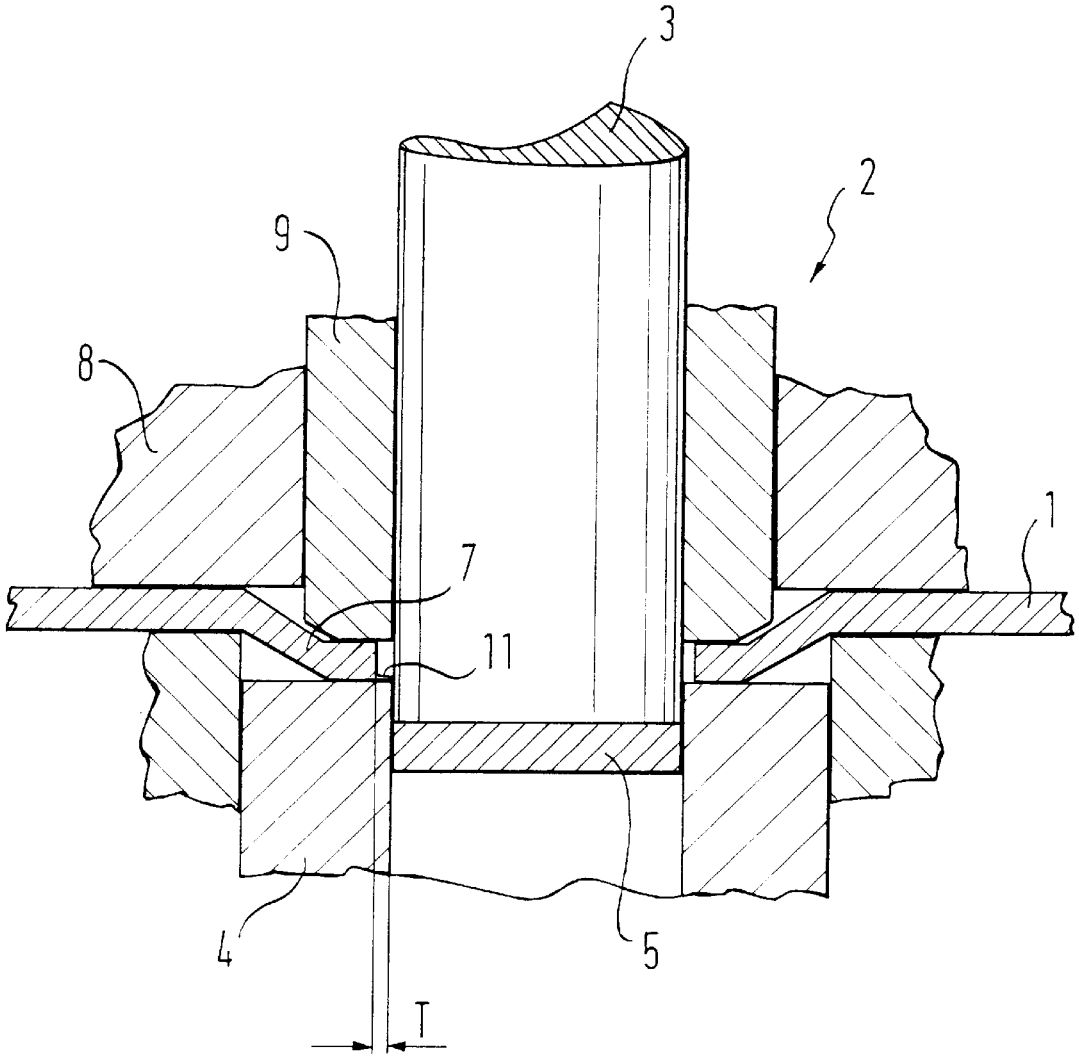
FIG. 3 is an enlarged, fragmentary, sectional view of a portion III of FIG. 2.

According to the invention, a burr ensues on the outside margin 6 in a flat form of the edges 7 at the hole shown in FIGS. 2 and 3, just as in the prior art. However, it is rendered harmless to the laundry and to the fingertips by a special way in which the tool is constructed. To that end, a female stamping die 9 is additionally disposed in the upper part 8 of the tool, and it seats itself on the sheet metal wall portion 1 of the drum after the cutting needle 3. First, the cutting needle 3 draws the edge 7 at the hole frustoconically outward, until the sheet metal wall portion 1 is seated on the stiffening piece 4. Then the needle 3 cuts out the hole portion 5, before the female stamping die deep-draws the edge 7 as far as the stiffening piece 4. In the process, a short meridian line of the truncated cone is cut to length, because it is drawn deeper, as a consequence of the offset shape of the female stamping die 9. However, in this process, the margin 6 of the edge 7 is drawn over a distance T of approximately 0.1 to 0.2 mm backward from the cutting needle 3 and carries its burr 11 along with it. The burr 11 is pulled over the margin of the stiffening piece 4 and as a result comes to be positioned somewhat farther inward in the hole. As soon as the cutting needle 3 moves upward again, its outer surface rubs along the burr 11 and pulls it upward somewhat, i.e. toward the interior of the drum, thereby rounding the burr. This takes the burr completely out of the reach of any fingertips. It has been found that the rounding allows any laundry fibers which might have reached the burr 11 to slide back off the burr again, so that tearing of fibers is then virtually precluded. It can be seen that the holes have a diameter which is larger, by an amount 2×T, than the cutting needles 3 of the tool that cut them.

FIG. 2 also shows outer portions 11 of the washing machine drum outside a sheet metal wall portion 1, as well as regions 10 of the sheet metal wall portion 1 surrounding the holes toward the outer portions 11. The regions 10 surrounding the holes have flat-formed edges 12 bordering the holes.

In FIG. 2, the holes have a diameter D, the flat-formed edges 12 of the sheet metal wall portion 1 bordering on the holes have a width B which is a fraction of the diameter D, and the regions 10 of the sheet metal wall portion 1 surrounding the holes have a diameter approximately twice the diameter D of the holes. Therefore, the female stamping die 9 has an offset end surface with a diameter D+2×B which is less than the outer diameter D+2×"10" of the surrounding regions 10.

Figure 4:
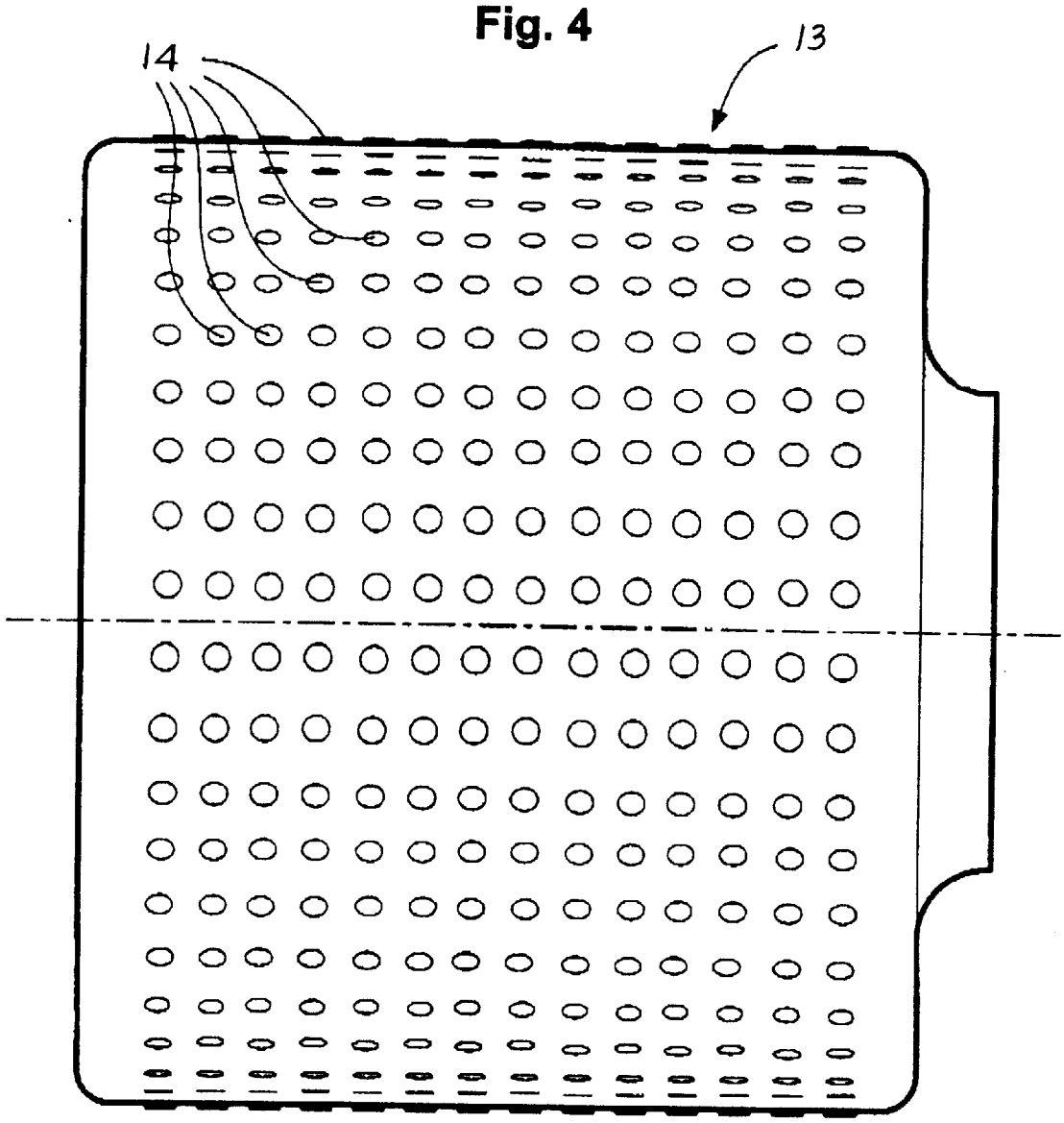
FIG. 4 is an elevational view of a washing machine drum.

In a washing machine drum 13, the holes which are constructed according to the invention are provided as flow holes 14, that are normally in the jacket of the laundry drum shown in FIG. 4. They may also be disposed in one or both bottom sheets of the laundry drum. By comparison, in a laundry drum of a washer-dryer, for instance, such holes are disposed only in a bottom sheet, through which warm air is blown into the drum.

I claim:

1. A laundry drum for a washing machine, comprising:

sheet-metal wall portions;

outer portions outside said sheet-metal wall portions;

said sheet-metal wall portions having holes formed therein for the passage of treatment media; said sheet-metal wall portions having regions surrounding said holes toward said outer portions;

said regions surrounding said holes having flat-formed flange-shaped edges bordering said holes and having one of a tulip shape and a frustoconical shape surrounding said flat-formed flange-shaped edges.

2. The laundry drum according to claim 1, wherein said holes have a given diameter, and said tulip shape of said surrounding regions has a diameter approximately twice said given diameter.

3. The laundry drum according to claim 1, wherein said holes have a given diameter, and said flat-formed flange-shaped edges have a width which is smaller than said given diameter.

4. The laundry drum according to claim 1, wherein said holes are cut by cutting needles of a tool, the cutting needles have a given diameter, and said holes have a diameter larger than the given diameter.

5. The laundry drum according to claim 1, wherein said holes have a given diameter, and said frustoconical shape of said surrounding regions has a diameter approximately twice said given diameter.

* * * * *